United States Patent [19]

Leikert

[11] Patent Number: 4,501,206

[45] Date of Patent: Feb. 26, 1985

[54] METHOD OF IGNITING A PULVERIZED-COAL PILOT-BURNER FLAME

[75] Inventor: Klaus Leikert, Gummersbach, Fed. Rep. of Germany

[73] Assignee: L. & C. Steinmüller GmbH, Gummersbach, Fed. Rep. of Germany

[21] Appl. No.: 590,207

[22] Filed: Mar. 16, 1984

Related U.S. Application Data

[63] Continuation of Ser. No. 358,540, Mar. 16, 1982, abandoned.

[30] Foreign Application Priority Data

Mar. 17, 1981 [DE] Fed. Rep. of Germany ..... 3110272

[51] Int. Cl.[3] ..... F23D 1/00

[52] U.S. Cl. ..... 110/347; 110/261; 110/263

[58] Field of Search ..... 110/347, 261, 263, 264, 110/265; 431/2

[56] References Cited

U.S. PATENT DOCUMENTS 4,221,174 9/1980 Smith et al. ..... 110/265

4,241,673 12/1980 Smith et al. ..... 110/347

*Primary Examiner*—Edward G. Favors

*Attorney, Agent, or Firm*—Becker & Becker, Inc.

[57] ABSTRACT

A method of igniting a pulverized-coal pilot-burner flame for a pulverized-coal annular burner flame having an internal back flow region, with the ignition energy being introduced centrally into the interior of the back flow region of the pulverized-coal annular burner flame. To ignite the pilot-burner flame during the process of the initial ignition, at constant primary and secondary air flow and an air coefficient $\lambda$—1.1 to 0.4, once or more a powder-laden air/powder mixture is supplied to the pilot-burner at a powder-laden air/powder weight ratio of 1.0 to 0.2. After ignition has been effected, a specified coal flow is continuously added to the pilot-burner flame at the fixed air coefficient $\lambda$—1.1 to 0.4.

5 Claims, No Drawings

METHOD OF IGNITING A PULVERIZED-COAL PILOT-BURNER FLAME

This is continuation of application Ser. No. 358,540—Leikert, filed Mar. 16, 1982, now abandoned.

The present invention relates to a method of igniting a pulverized-coal pilot-burner flame for a pulverized-coal annular burner flame having an internal back flow region, with the ignition energy being introduced centrally into the interior of the back flow region of the pulverized-coal annular burner flame.

It is known to ignite pulverized-coal annular burner flames by means of a so-called pulverized-coal pilot-burner. The pilot-burner itself requires an initial ignition in order to be able to ignite the burner flames; this initial ignition is produced in a known manner by gas-electrical, oil-electrical, or purely electrical means. The use of a pulverized-coal pilot-burner for a pulverized-coal operated annular burner is for the purpose of saving high-grade fuel, such as oil or gas, otherwise used for the ignition process.

It is also worthwhile to find a way for initial ignition of the pulverized-coal pilot-burner flame which also permits a minimizing of the initial ignition energy, and at the same time assures a reliable and stable ignition.

Accordingly, it is an object of the present invention to produce, for the ignition of a pulverized-coal pilot-burner flame, conditions which permit a minimizing of the initial ignition energy for the igniter of the pulverized-coal pilot-burner flame.

The method proposed according to the present invention to realize this object is characterized primarily in that for igniting the pilot-burner flame during the process of the initial ignition, at constant primary and secondary air flow and an air coefficient or factor $\lambda$—1.1–0.4, once or more a powder-laden air/powder mixture is supplied to the pilot-burner at a powder-laden air/powder weight ratio of 1.0 to 0.2; after ignition has been effected, a specified coal flow or stream is added continuously to the pilot-burner flame at the fixed air coefficient $\lambda$—1.1 to 0.4.

Optimum conditions for the initial ignition can advantageously be produced in every operating condition, for instance with cold as well as hot steam generators, as a result of the fact that during the process of the initial ignition, the powder-laden air/powder weight ratio is 1.0 to 0.2 at an air coefficient of $\lambda$—1.1 to 0.4, and is supplied once or more to the pilot-burner at this ratio. It is further advantageous with this ignition method, that different fuel characteristics are equalized or compensated and do not negatively influence the ignition process. It is known that, depending upon the operating conditions of the steam generator and the fuel characteristics, different powder-laden air/powder mixtures and air coefficients are optimum at the burner for initial ignition. The measures according to the present invention assure that the aforementioned functional interrelationships cover the range from the least to be the optimum ignition quality of fuels.

Further background information can be obtained from assignee's patent application Ser. No. 176,186, filed Aug. 7, 1980, abandoned, now replaced by straight continuation application Ser. No. 396,741, filed July 9, 1982, abandoned, said Patent Application Ser. No. 176,186 also having a continuation-in-part application Ser. No. 358,860—Leikert et al filed Mar. 17, 1982, now U.S. Pat. No. 4,466,363—Leikert et al dated Aug. 21, 1984 which is incorporated herein by reference thereto.

The present invention is, of course, in no way restricted to the specific disclosure of the specification, but also encompasses any modifications within the scope of the appended claims.

What I claim is:

1. A method of igniting a pulverized-coal pilot-burner flame for a pulverized-coal annular burner flame having an internal back flow region, with the ignition energy for said annular burner flame being introduced centrally into the interior of the back flow region of the annular burner flame for the purpose of saving highgrade fuel, such as oil or gas, otherwise used for the ignition process taking into account functional interrelationships as to ignition quality of fuels, said method comprising in combination the steps of:

carrying out an initial ignition of said pulverized-coal pilot-burner, said initial ignition being advantageously produced in every operating condition, for instance with cold as well as hot steam generators under conditions which permit a minimizing of the initial ignition energy for the igniter of the pulverized-coal pilot-burner flame;

effecting optimum quality reliable and stable ignition of said pulverized-coal pilot-burner flame during the process of said initial ignition, at constant primary and secondary air flow and a fixed air coefficient $\lambda$ of 1.1 to 0.4, by a step of supplying to said pilot-burner at least once a coal powder-laden air/coal powder mixture at a powder-laden air/powder weight ratio of 1.0 to 0.2; and after said ignition has been effected, continuously adding a specified coal flow to said pilot-burner flame at said fixed air coefficient $\lambda$ of 1.1 to 0.4 such that different fuel characteristics are equalized and compensated without negatively influencing the ignition process while assuring that functional interrelationships cover the range from the least to the optimum ignition quality of fuels.

2. A method of igniting a pulverized-coal pilot-burner flame for a pulverized-coal annular burner flame having an internal back flow region, with the ignition energy for said annular burner flame being introduced centrally into the interior of the back flow region of the annular burner flame for the purpose of saving highgrade fuel, such as oil or gas, otherwise used for the ignition process taking into account functional interrelationships as to ignition quality of fuels, said method comprising in combination the steps of:

providing an electrical heat source to ignite the pilot-burner flame;

providing a constant flow of primary and secondary air during ignition of the pilot-burner flame at a fixed air coefficient ($\lambda$) in the range of 1.1 to 0.4 by supplying a coal powder-laden air/coal powder mixture at a weight ratio in the range of 1.0 to 0.2; and after effecting ignition of the pilot-burner flame, continuously adding powdered coal to the pilot-burner flame at the fixed air coefficient in the range of 1.1 to 0.4 whereby variations in fuel characteristics are compensated for without hindering the ignition process so that fuels having a range of from least to optimum ignition qualities may be effectively burned.

3. A method in combination according to claim 2 wherein the electrical heat source is combined with fuel oil to ignite the pilot-burner flame.

4. A method in combination according to claim 2 wherein the electrical heat source is combined with combustible gas to ignite the pilot-burner flame.

5. In a method of igniting a pulverized-coal pilot-burner flame for a pulverized-coal annular burner flame having an internal back flow region, with the ignition energy for said annular burner flame being introduced centrally into the interior of the back flow region of the annular burner flame for the purpose of saving high-grade fuel, such as oil or gas, otherwise used for the ignition process taking into account functional interrelationships as to ignition quality of fuels, the improvement in combination therewith comprising the steps of:

first carrying out an initial ignition of said pulverized-coal pilot-burner with an electrical heat source to ignite the pilot-burner flame, said initial ignition being advantageously produced in every operating condition, for instance with cold as well as hot steam generators under conditions which permit a minimizing of the initial ignition energy for the igniter of the pulverized-coal pilot-burner flame;

effecting optimum quality reliable and stable ignition of said pulverized-coal pilot-burner flame during the process of said initial ignition by providing a constant primary and secondary air flow at a fixed air coefficient in a range of 1.1 to 0.4, by a step of supplying to said pilot-burner at least once a coal powder-laden air/coal powder mixture at a powder-laden air/powder weight ratio of 1.0 to 0.2; and then after effecting said ignition, continuously adding a specified powdered coal flow to said pilot-burner flame at said fixed air coefficient in a range of 1.1 to 0.4 such that different fuel characteristics are equalized and compensated without hindering the ignition process so that fuels having a range of ignition quantities may be effectively burned.

* * * * *